US005524296A

United States Patent [19]

Leighton

[11] Patent Number: 5,524,296

[45] Date of Patent: Jun. 11, 1996

[54] PLUNGER DEVICE

[76] Inventor: Lisa M. Leighton, 3253 Alta Laguna Beach Blvd., Laguna Beach, Calif. 92651

[21] Appl. No.: 368,029

[22] Filed: Jan. 3, 1995

Related U.S. Application Data

[63] Continuation-in-part of Ser. No. 74,327, Jun. 8, 1993, Pat. No. 5,384,918.

[51] Int. Cl.[6] ..... E03D 9/00

[52] U.S. Cl. ..... 4/255.05; 4/255.06

[58] Field of Search ..... 4/255.03, 255.05, 4/255.04, 255.06, 255.12

[56] References Cited

U.S. PATENT DOCUMENTS

| | | | |
|---|---|---|---|
| 716,090 | 12/1902 | Nyberg | 4/255.03 |
| 729,156 | 5/1903 | Geiger | 4/255.03 |
| 1,154,055 | 9/1915 | Reeves | 4/255.12 |
| 1,734,206 | 11/1929 | Fisch | 4/255.05 |
| 1,861,899 | 6/1932 | Beach, Jr. | 4/255.04 |
| 2,233,378 | 2/1941 | Wilson | 4/255.05 |
| 2,312,826 | 3/1943 | Leyden | 4/255.06 |
| 3,062,152 | 11/1962 | Huff, Sr. | 4/255.12 X |
| 4,144,598 | 3/1979 | Li | 4/255.06 |
| 4,320,539 | 3/1982 | Li | 4/255.06 |
| 4,756,480 | 7/1988 | Fish | 239/288.5 |
| 4,768,237 | 9/1988 | Torti | 4/255.05 |
| 5,020,166 | 6/1991 | Davenport | 4/255.06 |
| 5,384,918 | 1/1995 | Leighton et al. | 4/255.05 |

OTHER PUBLICATIONS

"Hydro–Plunger" of Richard Langenfeld Sales—2 pages, Nov. 1993.

*Primary Examiner*—Robert M. Fetsuga
*Attorney, Agent, or Firm*—Stetina Brunda & Buyan

[57] ABSTRACT

A plunger device for forcing waste through a drain line of a plumbing fixture comprising an elongate, tubular member. Fluidly connected to the top end of the tubular member is a valve assembly which is adapted to have a water supply source fluidly coupled thereto. The valve assembly comprises a valve stem which is reciprocally movable between open and closed positions and adapted to block the flow of water from the water supply source into the tubular member when in the closed position. The valve assembly further comprises a check valve for preventing the back-flow of water from the tubular member into the water supply source when the valve stem is in the open position, and at least one air inlet valve for creating a vacuum break when the fluid pressure in the valve assembly is less than atmospheric pressure. Attached to the valve assembly is at least one handle member, while fluidly connected to the bottom end of the tubular member is a plunger member.

12 Claims, 2 Drawing Sheets

Fig. 5
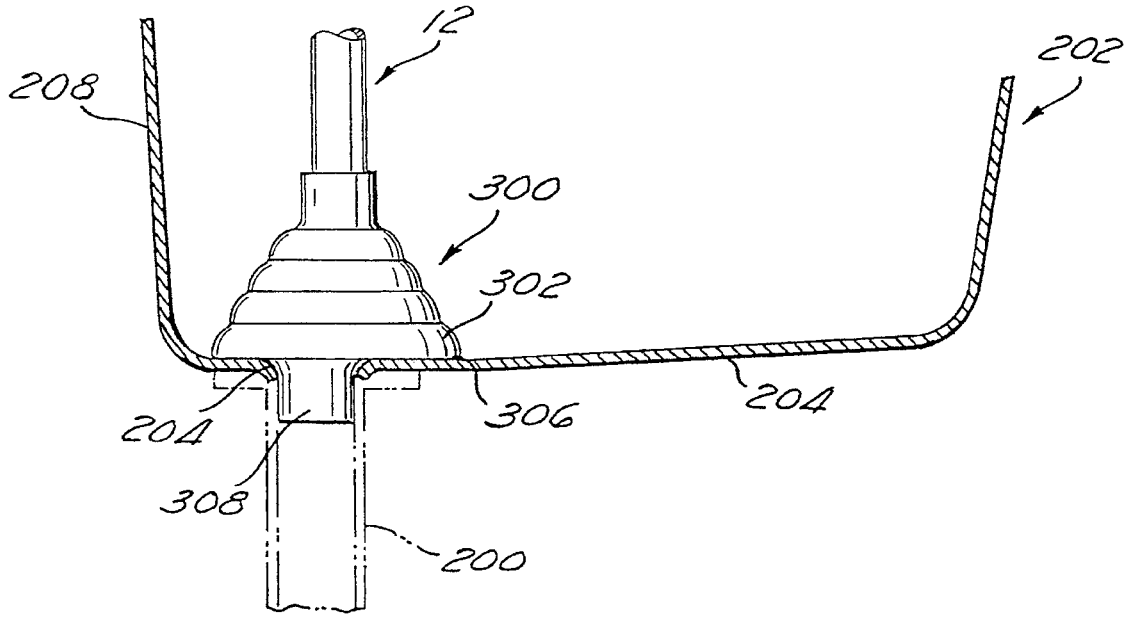
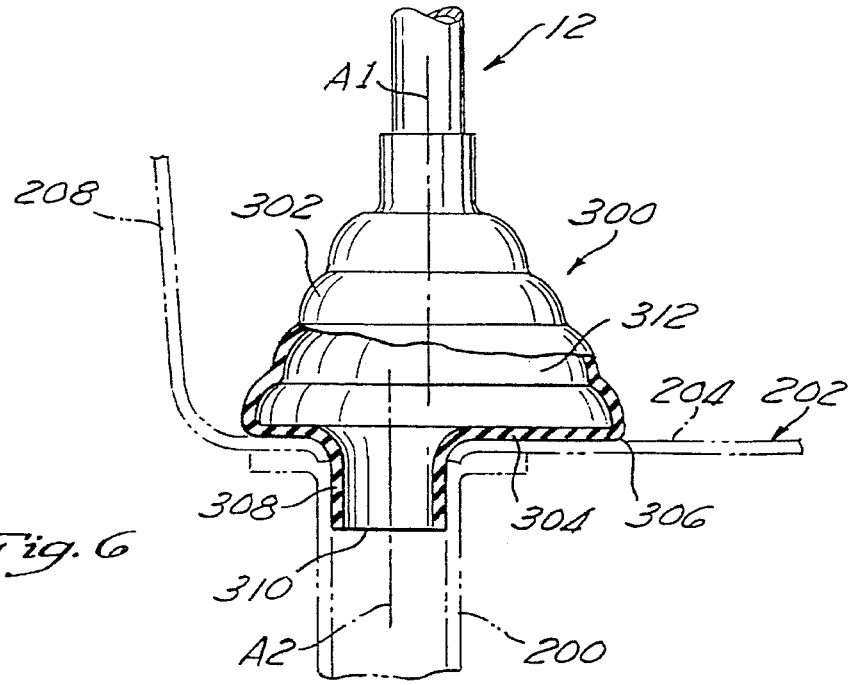
Fig. 6

PLUNGER DEVICE

FIELD OF THE INVENTION

The present application is a continuation-in-part of application Ser. No. 08/074,327 entitled PLUNGER DEVICE, filed on Jun. 8, 1993, now U.S. Pat. No. 5,384,918, the disclosure of which is expressly incorporated herein by reference. The present invention relates generally to plumbing equipment, and more particularly to a plunger device for forcing waste through the drain line of a plumbing fixture such as a sink or toilet bowl.

BACKGROUND OF THE INVENTION

A problem frequently associated with plumbing fixtures such as toilet bowls and sinks is the inadvertent clogging of the drain lines associated therewith. In this respect, toilet bowl drain lines are often clogged by an overabundance of toilet paper, while sinks are commonly clogged by debris such as hair, food waste products, etc. In the prior art, it is well known to use various types of chemical agents which are poured into the clogged basin to chemically dissolve the clog. However, a major disadvantage associated with the use of chemical agents is that these products are typically highly caustic and present health risks if ingested or exposed to the skin of the product user.

As an alternative to the use of the chemical agents, it is also well known to use a "plunger" which typically comprises an elongate wooden handle member having a cup-like member formed of rubber attached to one end thereof. The plunger is used by placing the open end of the cup-like member over the clogged drain and forcing the handle downwardly so as to invert the cup-like member, thus forcing the volume of water disposed therein into the clogged drain for purposes of dislodging the clog. Thereafter, the cup-like member is returned to its original, uninverted orientation so as to allow the same to be re-filled with a quantity of water. The aforementioned process is then repeated until such time as the clog is dislodged from the drain line.

Though the use of the "plunger" presents certain advantages over the use of chemical agents, this device possesses certain deficiencies which detracts from its overall utility. Foremost of these deficiencies is the frequent inability of the plunger to dislodge the clog within the drain line. In this respect, when the plunger handle is forced downwardly, only a relatively small volume of water is forced into the drain opening and hence the drain line. Additionally, the pressure at which the volume of water is forced into the drain line is also relatively low. Oftentimes, the forcing of the small water volume into the drain line at a relatively low pressure does not remove the clog from within the drain line, thus necessitating the use of alternative clog removing methods. The present invention overcomes these and other deficiencies associated with prior art plungers by providing a plunger device which may be used as an alternative to chemical agents and which introduces a high volume of water at high pressure into the drain line to remove a clog therefrom.

SUMMARY OF THE INVENTION

In accordance with the present invention, there is provided a plunger device for forcing waste through a drain line of a plumbing fixture such as a toilet bowl or sink. The plunger device comprises an elongate, tubular member having top and bottom ends. The plunger device further comprises a valve assembly including a housing which is fluidly connected to the top end of the tubular member and adapted to have a water supply source fluidly coupled thereto. The housing defines a flow passage between the water supply source and the tubular member.

In the preferred embodiment, the housing itself comprises a horizontally oriented, cylindrically configured upper section which defines an upper portion of the flow passage and is adapted to have the water supply source fluidly coupled thereto. The housing further comprises a vertically oriented, cylindrically configured lower section which defines a lower portion of the flow passage and includes a first end threadably connected to the upper section and a second end threadably connected to the top end of the tubular member.

Disposed within the flow passage of the housing is a valve stem which is reciprocally movable between a closed position where the flow passage is blocked and an open position wherein the flow passage is unblocked. Disposed on the valve stem is a spring for biasing the valve stem to the closed position. Additionally, disposed within the upper section of the housing and cooperatively engaged to one end of the valve stem is an actuation button for selectively moving the valve stem from the closed position to the open position. In addition to being biased to the closed position by the spring disposed thereon, the valve stem is preferably configured so as to be biased toward the closed position by the fluid pressure within the upper portion of the flow passage.

Also disposed within the flow passage is a check valve for preventing the back-flow of water from the tubular member into the water supply source when the valve stem is in the open position. In the preferred embodiment, the check valve comprises a valve ring which is disposed within the lower portion of the flow passage and defines an annular sealing surface. The check valve further comprises a retaining pin which extends laterally through the tubular member adjacent the top end thereof, and a spherical float member which is movably confined between the valve ring and the retaining pin. The float member is held against the retaining pin when the valve stem is moved to the open position, and adapted to be seated against the sealing surface by the back-flow of water in the tubular member.

Attached to the upper section of the housing and extending therefrom in opposed relation is a pair of identically configured elongate, tubular handle members. The tubular member, housing and handle members are each preferably fabricated from polyvinyl chloride. Additionally, fluidly connected to the bottom end of the tubular member is a hollow plunger member. The plunger member comprises a bell-shaped upper portion which has an annular lower surface defining a peripheral edge. Extending downwardly from the lower surface is a generally cylindrical portion having an outer diameter dimension slightly exceeding the inner diameter dimension of the drain line. Disposed within the cylindrical portion is an outlet port. The upper portion and cylindrical portion define an interior cavity which is in fluid communication with the tubular member. The cylindrical portion is adapted to form a first seal against the inner surface of the drain line when received thereinto, with the peripheral edge of the upper portion forming a second seal against the portion of the interior surface of the plumbing fixture surrounding the drain opening when the cylindrical portion is received into the drain line. Upon the establishment of the first and second seals, water is directed from the water supply source, through the plunger device, and into the drain line via the outlet port.

The cylindrical portion of the plunger member is selectively invertible and disposed within the interior of the upper portion when inverted. The cylindrical portion is preferably initially inverted when the plunger device is used, and is caused to be moved to its original, extended orientation in a manner forming the first seal against the inner surface of the drain line. Additionally, the cylindrical portion may be formed in a manner wherein the axis defined thereby extends in spaced, generally parallel relation to the axis defined by the upper portion, such that the cylindrical portion is laterally offset with respect to the upper portion.

Disposed within the housing is at least one air inlet valve for creating a vacuum break when the fluid pressure in the flow passage is less than atmospheric pressure. The air inlet valve is preferably disposed within the upper section of the housing intermediate the upper portion of the flow passage and a respective one of the handle members. The air inlet valve comprises an umbrella valve which, in operation, creates the vacuum break by placing the upper portion of the flow passage in fluid communication with ambient air via a handle member when the fluid pressure in the flow passage is less than atmospheric pressure.

BRIEF DESCRIPTION OF THE DRAWINGS

These, as well as other features of the present invention, will become more apparent upon reference to the drawings wherein:

FIG. 5 is a side elevational view of an alternative plunger member which may be incorporated into the plunger device, illustrating the manner in which the plunger member is inserted into the drain line of a sink; and FIG. 6 is an enlarged, partial cross-sectional view of the plunger member shown in FIG. 5.

DETAILED DESCRIPTION OF THE PREFERRED EMBODIMENT

Figure 1:
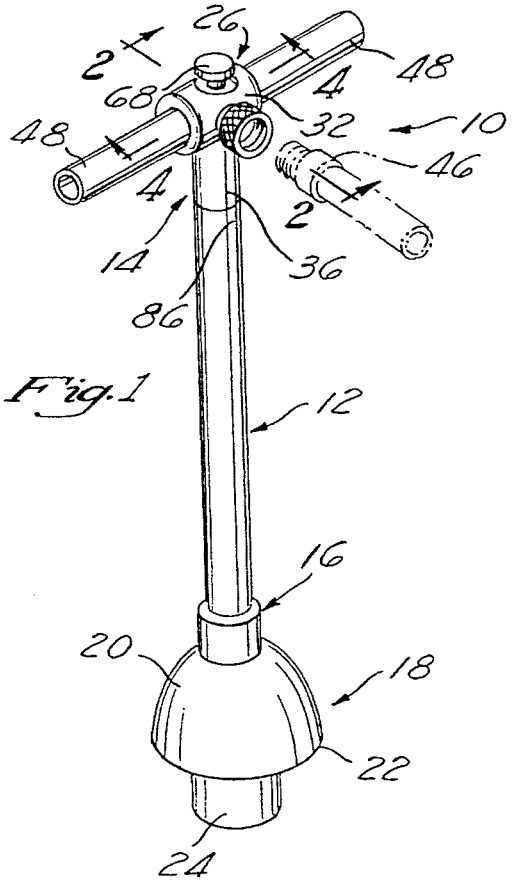
FIG. 1 is a perspective view of the plunger device constructed in accordance with the present invention.

Referring now to the drawings wherein the showings are for purposes of illustrating a preferred embodiment of the present invention only, and not for purposes of limiting the same, FIG. 1 perspectively illustrates a plunger device 10 constructed in accordance with the present invention. The plunger device 10 is used for forcing waste through a drain line of a plumbing fixture such as a toilet bowl or sink, and comprises an elongate, tubular member 12 having a top end 14 and a bottom end 16.

Fluidly connected to the bottom end 16 of the tubular member 12 is a hollow plunger member 18 which is preferably fabricated from a flexible material such as rubber. The plunger member 18 comprises a generally bell-shaped upper portion 20 which has an annular lower surface defining a peripheral edge 22. Extending axially downwardly from the lower surface of the upper portion 20 is a generally cylindrical portion 24 which preferably has an outer diameter dimension slightly exceeding the inner diameter dimension of the drain line, and includes an outlet port disposed within the distal end thereof. The upper portion 20 and cylindrical portion 24 define an interior cavity which is in fluid communication with the tubular member 12 when the plunger member 18, and in particular the upper portion 20 thereof, is fluidly connected to the bottom end 16. In the preferred embodiment, the cylindrical portion 24 forms a first seal against the inner surface of the drain line when received thereinto, with the peripheral edge 22 forming a second seal against a portion of the interior surface of the plumbing fixture surrounding the drain opening when the cylindrical portion 24 is fully received into the drain line. Though the outer diameter of the cylindrical portion 24 slightly exceeds the inner diameter of the drain line, the rubber construction of the plunger member 18 allows the cylindrical portion 24 to be slightly compressed as it is being received into the smaller drain line. The resultant abutment of the outer surface of the cylindrical portion 24 against the inner surface of the drain line facilitates the formation of the first seal. As will be discussed in more detail below, upon the establishment of the first and second seals, water is directed through the plunger device 10 and into the drain line via the outlet port disposed within the cylindrical portion 24 of the plunger member 18. The rubber construction of the plunger member 18 also allows the upper portion 20 thereof to be collapsed upon the downward movement of the tubular member 12.

Referring now to FIGS. 5 and 6, from time to time it may be desirable to utilize the plunger device 10 to remove waste from within the drain line 200 of a sink or basin 202 wherein the drain opening 204 of the drain line 200 is not centrally located within the bottom wall 206 of the sink 202, but rather located adjacent one side wall 208 thereof. As will be recognized, it would be difficult to insert the cylindrical portion 24 of the previously described plunger member 18 into the drain line 200 due to the cylindrical portion 24 extending axially downwardly from the lower surface of the upper portion 20. In this respect, due to the cylindrical portion 24 being disposed centrally within the lower surface of the upper portion 20, the peripheral edge 22 of the upper portion 20 would most likely interfere with the side wall 208 of the sink 202 when attempting to insert the cylindrical portion 24 into the drain line 200.

In view of the foregoing, a plunger member 300 may be fluidly connected to the bottom end 16 of the tubular member 12 as an alternative to the previously described plunger member 18. The plunger member 300 is preferably fabricated from a flexible material such as rubber, and comprises a generally bell-shaped upper portion 302 which includes a lower surface 304 defining a peripheral edge 306. Extending downwardly from the lower surface 304 of the upper portion 302 is a tubular, generally cylindrical portion 308 which preferably has an outer diameter dimension slightly exceeding the inner diameter dimension of the drain line 200, and includes an outlet port 310 disposed within the distal end thereof. The upper portion 302 and cylindrical portion 308 define an interior cavity 312 which is in fluid communication with the tubular member 12 when the plunger member 300, and in particular the upper portion 302 thereof, is fluidly connected to the bottom end 16 of the tubular member 12.

As best seen in FIG. 6, the upper portion 302 of the plunger member 300 defines a first axis A1, with the cylindrical portion 308 defining a second axis A2. In the plunger member 300, the first and second axes A1, A2 extend in spaced, generally parallel relation to each other. As such, the cylindrical portion 308 is laterally offset from the center of the upper portion 302. As will be recognized, the offset of the cylindrical portion 308 toward the peripheral edge 306 of the upper portion 302 allows the cylindrical portion 308 to be easily inserted into the drain line 200 despite the same being located adjacent the side wall 208 of the sink 202. The cylindrical portion 308 forms a first seal against the inner surface of the drain line 200 when received thereinto, with the lower surface 304 of the upper portion 302 and peripheral edge 306 thereof forming a second seal against the bottom wall 206 of the sink 202 surrounding the drain opening 204 when the cylindrical portion 308 is fully received into the drain line 200. As in the plunger member 18, though the outer diameter of the cylindrical portion 308 slightly exceeds the diameter of the drain line 200, the rubber construction of the plunger member 300 allows the cylindrical portion 308 to be compressed as it is being received into the drain line 200, with the resultant abutment of the outer surface of the cylindrical portion 308 against the inner surface of the drain line 200 facilitating the formation of the first seal. Upon the establishment of the first and second seals, water is directed through the plunger device 10 and into the drain line 200 via the outlet port 310 disposed within the cylindrical portion 308 of the plunger member 300. The rubber construction of the plunger member 300 also allows the upper portion 302 thereof to be collapsed upon the downward movement of the tubular member 12.

Referring now to FIGS. 1–4, the plunger device 10 further comprises a valve assembly 26 which includes a housing 28 fluidly connected to the top end 14 of the tubular member 12. The housing 28 is adapted to have a water supply source 30 such as a conventional garden hose (shown in phantom FIG. 1) fluidly coupled thereto, and defines a flow passage between the water supply source 30 and the tubular member 12. The housing 28 itself preferably comprises a horizontally oriented, cylindrically configured upper section 32 which defines an upper portion 34 of the flow passage. In addition to the upper section 32, the housing 28 comprises a vertically oriented, cylindrically configured lower section 36 which defines a lower portion 38 of the flow passage.

In the preferred embodiment, the upper and lower sections 32, 36 are threadably connected to each other via the receipt of the reduced diameter, externally threaded top end 40 of the lower section 36 into a complementary, internally threaded annular recess 42 formed in the bottom of the upper section 32 about one end of the upper portion 34 of the flow passage. Disposed about the top end 40 of the lower section 36 is an O-ring 44 which is compressed between the upper and lower sections 32, 36 when threadably connected to each other. The bottom end 41 of the lower section 36 is internally threaded so as to be threadably connectable to the reduced diameter, externally threaded top end 14 of the tubular member 12. The end of the upper portion 34 of the flow passage opposite that including the recess 42 formed thereabout is internally threaded so as to allow an externally threaded adaptor 46 disposed on one end of the water supply source 30 (i.e., garden hose) to be threadably connected to the upper section 32 and hence the housing 28. When the upper and lower sections 32, 36 of the housing 28 are threadably connected to each other, the upper and lower portions 34, 38 of the flow passage combine to define the continuous flow passage from the water supply source 30 to the tubular member 14. Though not shown, the upper and lower sections 32, 36 may be formed as a single, unitary component, thus eliminating the need for the O-ring 44.

Figure 4:
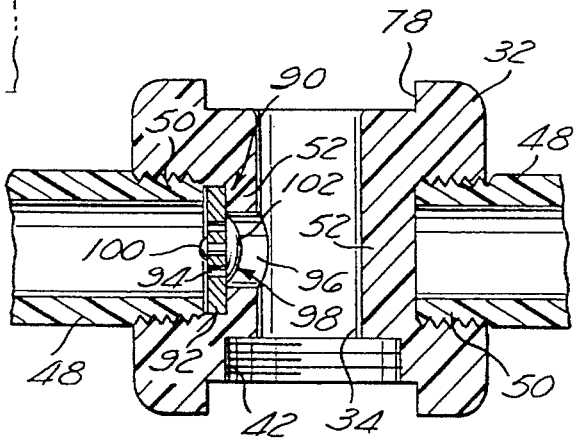
FIG. 4 is a partial cross-sectional view of the valve assembly of the plunger device (excluding the valve stem and actuation button) taken along line 4—4 of FIG. 1.

Attached to the upper section 32 of the housing 28 and extending horizontally therefrom in opposed relation is a pair of identically configured elongate, tubular handle members 48. As best seen in FIG. 4, the handle members 48 are threadably connected to the upper section 32 via the receipt of the reduced diameter, externally threaded ends 50 thereof into respective ones of complementary, internally threaded recesses disposed in the opposed longitudinal ends of the upper section 32. When the handle members 48 are fully received into the upper section 32, the ends 50 thereof are each separated from the upper portion 34 of the flow passage by a respective wall 52. In the preferred embodiment, the tubular member 12, housing 28 (including the upper and lower sections 32, 36) and handle members 48 are each fabricated from polyvinyl chloride, though it will be recognized that other suitable materials may be utilized as an alternative.

Figure 2:
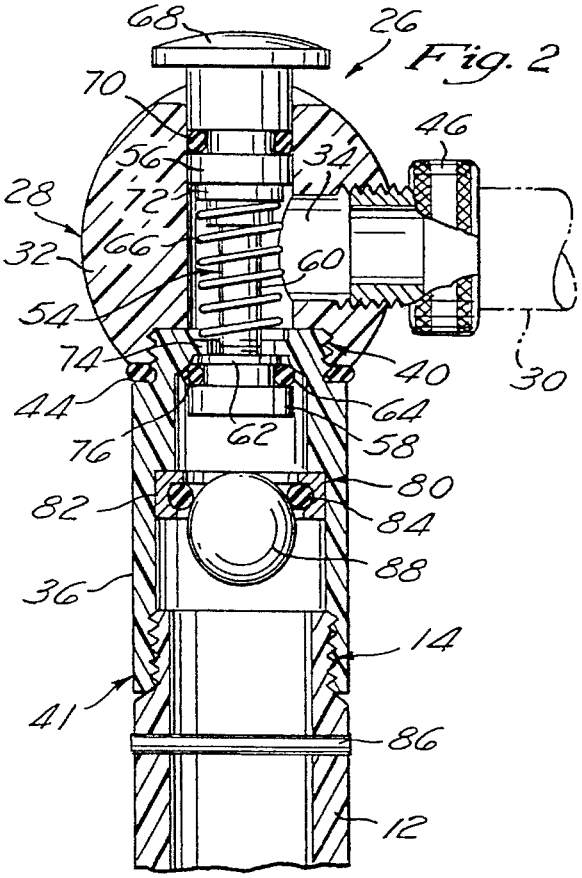
FIG. 2 is a cross-sectional view of the valve assembly of the plunger device taken along line 2—2 of FIG. 1, illustrating the valve assembly in a closed configuration.
Figure 3:
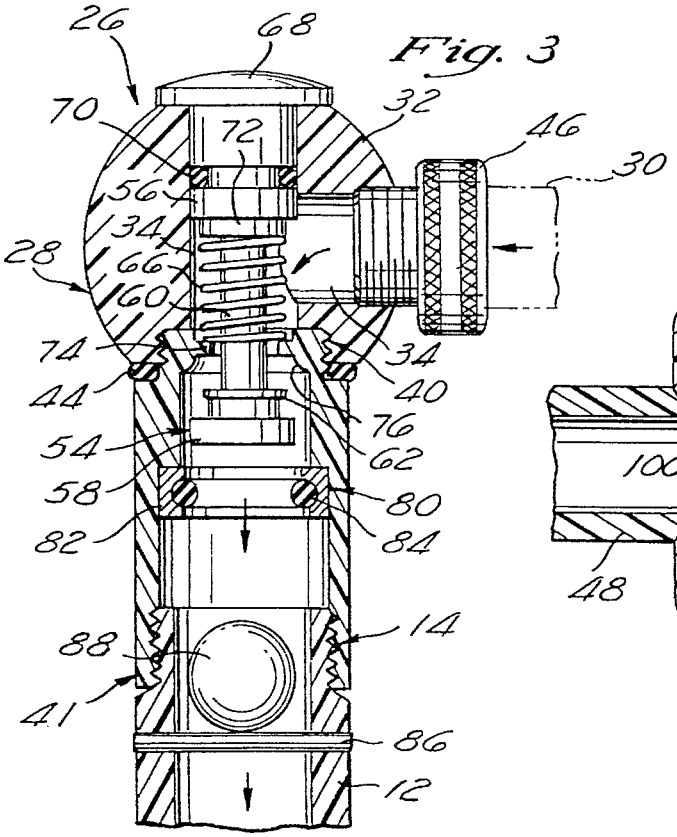
FIG. 3 is a cross-sectional view of the valve assembly of the plunger device, illustrating the valve assembly in an open configuration.

Disposed within the flow passage of the housing 28, and predominantly within the upper portion 34 of the flow passage, is a valve stem 54. As best seen in FIGS. 2 and 3, the valve stem 54 defines first and second flange portions 56, 58 which are identically sized and have a reduced diameter stem portion 60 extending axially therebetween. Disposed within an annular channel defined between the second flange portion 58 and a third flange portion 62 formed about the stem portion 60 is an O-ring 64. The diameter of the third flange portion 62 is slightly less than the diameter of the second flange portion 58, with the width (i.e., thickness) thereof being substantially less than the width of the second flange portion 58. Disposed on the stem portion 60 of the valve stem 54 is a helical biasing spring 66. Additionally, attached to the end of the valve stem 54 disposed closest to the first flange portion 56 is an actuation button 68. The actuation button 68 includes an enlarged, circularly figured head portion having a lower, cylindrical portion extending axially therefrom. Though not shown, the cylindrical portion includes a bore extending axially therein which is sized and configured to receive the end of the valve stem 54. Disposed within an annular channel defined between the first flange portion 56 and the distal end of the cylindrical portion of the actuation button 68 is an O-ring 70.

In the preferred embodiment, the valve stem 54 is reciprocally movable within the housing 28 between a closed position (as shown in FIG. 2) wherein the flow passage, and in particular the lower portion 38 thereof, is blocked, and an open position (as shown in FIG. 3) wherein the lower portion 38 of the flow passage is unblocked. The valve stem 54 is oriented within the housing 28 in a manner wherein the biasing spring 66 disposed on the stem portion 60 thereof is captured between an annular shoulder 72 formed about the stem portion 60 immediately adjacent the first flange portion 56 and an annular lip 74 formed about and extending radially inwardly from the inner surface of the top end 40 of the lower section 36. In this respect, one end of the biasing spring 66 is abutted against the shoulder 72, with the opposite end being abutted against the lip 74. The lower cylindrical portion of the actuation button 68 which is attached to the end of the valve stem 54 disposed closest to the first flange portion 56 resides within a bore extending from the top of the upper section 32 to the upper portion 34 of the flow passage. Additionally, the second and third flange portions 58, 62 of the valve stem 54 are disposed within the lower portion 38 of the flow passage.

The biasing spring 66 normally biases the valve stem 54 to the closed position shown in FIG. 2. When the valve stem 54 is biased to the closed position, the O-ring 64 disposed within the annular channel defined between the second and third flange portions 58, 62 is abutted against an arcuately contoured, annular sealing surface 76 which is defined between the lip 74 and remainder of the inner surface of the lower section 36. As will be recognized, the abutment of the O-ring 64 against the sealing surface 76 effectively blocks the lower portion 38 of the flow passage and prevents the flow of water from the upper portion 34 of the flow passage thereinto. Importantly, when the valve stem 54 is in the closed position, the fluid pressure within the upper portion 34 of the flow passage acts against the first flange portion 56 of the valve stem 54 which, along with the lower cylindrical portion of the actuation button 68, resides within the bore extending from the top of the upper section 32 into the upper portion 34 of the flow passage. Advantageously, the fluid pressure acting against the first flange portion 56 also biases the valve stem 54 to the closed position, thus allowing the biasing spring 66 used therewith to be of a smaller size.

The valve stem 54 is actuated from the closed position to the open position by the selective application of downward pressure to the circularly configured head portion of the actuation button 68. In this respect, pressing the actuation button 68 facilitates the compression of the biasing spring 66, which in turn results in the O-ring 64 moving downwardly out of contact with the sealing surface 76. The downward axial travel of the valve stem 54 is limited by the abutment of the head portion of the actuation button 68 against the bottom surface of a circularly configured recess 78 which is formed in the top of the upper section 32 and sized to accommodate the head portion of the actuation button 60. When the valve stem 54 is actuated from the closed position to the open position (i.e., the O-ring 64 is moved downwardly out of contact with the sealing surface 76), the water previously maintained under pressure within the upper portion 34 of the flow passage flows through the gap defined between the stem portion 60 and lip 74, and into the lower portion 38 of the flow passage (and hence the tubular member 12).

The seal created by the abutment of the O-ring 70 against the inner surface of the upper section 32 which defines the bore extending from the top thereof to the upper portion 34 of the flow passage prevents any of the water maintained under pressure within the upper portion 34 from leaking between the upper section 32 and actuation button 68. Similarly, the compression of the O-ring 44 between the upper and lower sections 32, 36 of the housing 28 prevents any of the water maintained under pressure within the upper portion 34 of the flow passage from leaking therebetween. As the valve stem 54 is actuated from the closed position to the open position, the seal created by the O-ring 70 is maintained despite the same sliding along the inner surface of the upper section 32 defining the bore extending from the top thereof to the upper portion 34 of the flow passage.

As further seen in FIGS. 2 and 3, the valve assembly 26 of the plunger device 10 further comprises a check valve 80 which is disposed within the lower portion 38 of the flow passage for preventing the back-flow of water from the tubular member 12 into the water supply source 30 when the valve stem 54 is in the open position. In the preferred embodiment, the check valve 80 comprises a valve ring 82 which is disposed within the lower portion 38 of the flow passage and abutted against an annular shoulder defined within the inner surface of the lower section 36 of the housing 28. Formed in the inner surface of the valve ring 82 is an annular, generally U-shaped channel having an O-ring 84 disposed therein. In addition to the valve ring 82, the check valve 80 comprises a retaining pin 86 which extends laterally through the tubular member 12 adjacent the externally threaded top end 14 thereof. The retaining pin 86 is sized such that the opposed ends thereof are substantially flush with the outer surface of the tubular member 12.

In addition to the valve ring 82 and retaining pin 86, the check valve 80 comprises a spherical float member 88 which is movably confined between the valve ring 82 and retaining pin 86. When the valve stem 54 is moved to the open position, the flow of water into the lower portion 38 of the flow passage forces the float member 88 against the retaining pin 86, with the water flowing around the float member 88 and through the remainder of the tubular member 12. In the event of a back-flow of water within the tubular member 12, such back-flow forces the float member 88 upwardly toward the valve ring 82 and into sealed engagement with the O-ring 84, thus preventing such flow of water from entering the upper portion 34 of the flow passage, despite the valve stem 54 being in the open position.

Referring now to FIG. 4, the valve assembly 26 further comprises at least one air inlet valve 90 disposed within the upper section 32 of the housing 28 for creating a vacuum break when the fluid pressure in the flow passage, and in particular the upper portion 34 thereof, is less than atmospheric pressure. For purposes of clarity, the valve stem 54, actuation button 68 and lower section 36 of the housing 28 have not been included in FIG. 4. In the preferred embodiment, the air inlet valve 90 is disposed between the upper portion 34 of the flow passage and the hollow interior of a respective one of the handle members 48. The air inlet valve 90 is preferably an umbrella type valve, and comprises a circularly configured valve plate 92 which is captured (i.e., compressed) between the externally threaded end 50 of a handle member 48 and an annular shoulder formed within the adjacent wall 52 of the upper section 32. The valve plate 92 includes a plurality of vent apertures 94 disposed therein which place the hollow interior of the handle member 48 into fluid communication with the upper portion 34 of the flow passage via an opening 96 formed in the wall 52.

In addition to the valve plate 92, the air inlet 90 comprises a sealing member 98 defining a central portion 100 which is received into a complementary aperture disposed within the center of the valve plate 92, and an arcuately contoured cap portion 102 which resides within the opening 96 and is sized and configured to cover and seal the vent apertures 94 of the valve plate 92. The sealing member 98 is typically fabricated from rubber or a similar resilient material. As will be recognized, the cap portion 102 of the sealing member 98 normally prevents the flow of ambient air from the interior of the handle member 48 into the upper portion 34 of the flow passage via the vent apertures 94 and opening 96. The use of the air inlet valve 90 will be described in more detail below.

In utilizing the plunger device 10, the water supply source 30 is fluidly coupled to the upper section 32 of the housing 28 in the aforementioned manner. Thereafter, the handle members 48 are grasped by the hands of the user, with the plunger member 18, 300 being lowered to the drain opening of the plumbing fixture. When the plunger member 18, 300 is initially lowered to the drain opening, the cylindrical portion 24, 308 thereof is pushed into the drain line, with the peripheral edge 22, 306 of the upper portion 20, 302 being abutted against the interior surface of the plumbing fixture surrounding the drain opening. As previously explained, the receipt of the cylindrical portion 24, 308 into the drain line and abutment of the peripheral edge 22, 306 against the interior surface of the plumbing fixture facilitates the formation of the first and second seals.

Thereafter, the head portion of the actuation button 68 is pressed by the thumb of one hand of the user, thus moving the valve stem 54 to the open position. Once moved to the open position, the water flows from the upper portion 34 of the flow passage into the lower portion 38 thereof, and subsequently into the tubular member 12. Water flowing downwardly through the tubular member 12 enters the interior cavity of the plunger member 18, 300, and subsequently enters the drain line of the plumbing fixture via the outlet port disposed within the cylindrical portion 24, 308 of the plunger member 18, 300.

As water is flowing from the supply source 30 into the drain line of the plumbing fixture via the plunger device 10, constant downward pressure is applied to the handle members 48 by the user so as to maintain the peripheral edge 22, 306 of the upper portion 20, 302 of the plunger member 18, 300 in sealed engagement with the interior surface of the plumbing fixture. Due to the formation of the first and second seals, water is forced into the drain line at line pressure which in and of itself usually suffices to force the clog out of the drain line. In the event the line pressure of the water supply source 30 does not cause the clog to be removed from within the drain line, an additional volume of water may be forced thereinto to facilitate the clog removal. In this respect, since the plunger member 18, 300 is hollow, the interior cavity defined therewithin is filled with water when the valve stem 54 is actuated to the open position. The volume of water confined within the interior cavity of the plunger member 18, 300 may be forced into the drain line at high pressure by thrusting the handle members 48 downwardly in a conventional manner so as to collapse the bell-shaped upper portion 20, 302 of the plunger member 18, 300. Thereafter, the upper portion 20, 302 may be returned to its original configuration by pulling upwardly on the handle members 48, thus allowing the interior cavity to be refilled with water via the water supply source 30. Importantly, the first and second seals formed between the plunger member 18, 300 and plumbing fixture need not be broken to allow the interior cavity to be re-filled with water due to the continuous water flow facilitated by the movement of the valve stem 54 to the open position. The aforementioned process may then be repeated until such time as sufficient water pressure is applied to remove the clog. As such, the use of the plunger device 10 allows a significantly greater volume of water to be forced into the drain line at a significantly greater pressure than that which is obtainable through the use of a conventional plunger. After the clog has been dislodged, downward pressure is removed from the head portion of the actuation button 68, thus returning the valve stem 54 to the closed position.

In the plunger device 10, the cylindrical portion 24, 308 of the plunger member 18, 300 may be adapted to be selectively invertible and disposed within the interior of the upper portion 20, 302 when inverted. In this respect, the cylindrical portion 24, 308 would be pushed to the inverted orientation prior to the lowering of the plunger member 18,300 to the drain opening. The plunger device 10 would then be manipulated so as to orient the inverted cylindrical portion 24, 308 over the drain opening and to abut the peripheral edge 22, 306 of the lower surface of the upper portion 20, 302 against the inner surface of the basin, thus forming the second seal. Upon the pressing of the actuation button 68, the resultant downward flow of water through the tubular member 12 and into the interior of the upper portion 20, 302 would force the inverted cylindrical portion 24, 308 downwardly into the drain opening and hence the drain line, thus forming the first seal.

Occasionally, when the plunger device 10 is being utilized, a back-flow of water will occur in the tubular member 12. As previously explained, such a back-flow causes the float member 88 of the check valve 80 (which is held against the retaining pin 86 when the valve stem 54 is initially moved to the open position) to be forced against the O-ring 84 disposed within the valve ring 82, thus preventing the water from flowing upwardly into the upper portion 34 of the flow passage despite the valve stem 54 being in the open position.

In addition to the occasional back-flow of water within the tubular member 12, from time to time the line pressure in the water supply source 30 may decrease and create a vacuum, thus causing the pressure within the flow passage, and in particular the upper portion 34 thereof, to fall below atmospheric pressure. This decrease in pressure allows water from within the drain line to rise upwardly into the plunger member 18, 300 and tubular member 12. Though the check valve 80 disposed within the lower portion 38 of the flow passage is adapted to prevent the back-flow of water into the upper portion 34, it is still desirable to prevent the water within the drain line from being pulled upwardly toward the water supply source 30 so as to prevent any inadvertent contamination thereof in the event that the check valve 80 fails to function properly. As such, the air inlet valve 90 is provided to prevent such contamination. In this respect, a vacuum within the upper portion 34 of the flow passage causes the cap portion 102 of the air inlet valve 90 to be pulled away from the valve plate 92, thus allowing ambient air entering the handle member 48 via the open distal end thereof to enter the upper portion 34 of the flow passage via the vent apertures 94 and opening 96. This channeling of ambient air into the upper portion 34 of the flow passage immediately discontinues the flow of water upwardly within the tubular member 12.

Additional modifications and improvements of the present invention may also be apparent to those skilled in the art. Thus, the particular combination of part described and illustrated herein is intended to represent only a preferred embodiment of the present invention, and is not intended to serve as limitations of alternative devices within the spirit and scope of the invention.

What is claimed is:

1. A plunger device for forcing waste through a drain line of a plumbing fixture, comprising:

an elongate, tubular member having top and bottom ends;

a valve assembly comprising:

(a) a housing fluidly connected to the top end of the tubular member and adapted to have a water supply source fluidly coupled thereto, said housing defining a flow passage between the water supply source and the tubular member;

(b) a valve stem disposed within said flow passage and reciprocally movable between a closed position wherein said flow passage is blocked and an open position wherein said flow passage is unblocked;

(c) a check valve disposed within said flow passage for preventing the back-flow of water from the tubular member into the water supply source when the valve stem is in the open position; and (d) at least one air inlet valve disposed within said housing for creating a vacuum break when the fluid pressure in the flow passage is less than atmospheric pressure;

at least one elongate, tubular handle member attached to said housing; and a plunger member fluidly connected to the bottom end of said tubular member;

wherein said valve assembly further comprises:

(e) a spring disposed on said valve stem for biasing the valve stem to the closed position; and (f) an actuation button disposed within said housing and cooperatively engaged to one end of the valve stem for selectively moving the valve stem from the closed position to the open position.

2. The device of claim 1 wherein said valve stem is configured so as to be biased toward the closed position by the fluid pressure within the flow passage.

3. The device of claim 1 wherein said air inlet valve is disposed within said housing intermediate said flow passage and said handle member, and is operable to create the vacuum break by placing said flow passage in fluid communication with ambient air via said handle member when the fluid pressure in the flow passage is less than atmospheric pressure.

4. The device of claim 3 wherein said air inlet valve comprises an umbrella valve.

5. The device of claim 3 comprising a pair of handle members attached to and extending from said housing in opposed relation, said air inlet valve being disposed within said housing intermediate said flow passage and a respective one of said handle members.

6. The device of claim 1 wherein said housing comprises:

a cylindrically configured upper section defining an upper portion of said flow passage, said upper section being adapted to have said water supply source fluidly connected thereto and including said air inlet valve disposed therein and said handle member attached thereto; and a cylindrically configured lower section defining a lower portion of said flow passage, said lower section having a first end attached to said upper section and a second end attached to the top end of the tubular member.

7. The device of claim 6 wherein said first end of the lower section is threadably connected to the upper section, and the second end of the lower section is threadably connected to the top end of the tubular member.

8. The device of claim 6 wherein said check valve comprises:

a valve ring disposed within the lower portion of the flow passage and defining an annular sealing surface;

a retaining pin extending laterally through the tubular member adjacent the top end thereof; and a spherical float member movably confined between said valve ring and said retaining pin;

said float member being seated against the sealing surface by the back-flow of water in the tubular member and held against the retaining pin when the valve stem is moved to the open position.

9. The device of claim 1 wherein said plunger member defines an interior cavity which is in fluid communication with the tubular member and includes a fluid outlet port, said plunger member being sized and configured to cover and form at least one fluid-tight seal about a drain opening of said plumbing fixture in a manner wherein water is directed from the water supply source, through the plunger device, and into the drain line via the outlet port.

10. The device of claim 9 wherein said plunger member comprises:

a bell-shaped upper portion having an annular lower surface defining a peripheral edge; and a generally cylindrical portion extending downwardly from the lower surface and having an outer diameter dimension slightly exceeding the inner diameter dimension of the drain line, said outlet port being disposed within said cylindrical portion;

said cylindrical portion forming a first seal against the inner surface of the drain line when received thereinto, and said peripheral edge forming a second seal against a portion of the interior surface of said plumbing fixture surrounding said drain opening when said cylindrical portion is received into the drain line.

11. The device of claim 1 wherein said tubular member, said housing and said at least one handle member are fabricated from polyvinyl chloride.

12. A plunger device for forcing waste through a drain line of a plumbing fixture, comprising:

an elongate, tubular member having top and bottom ends;

a valve assembly comprising:

(a) a housing fluidly connected to the top end of the tubular member and adapted to have a water supply source fluidly coupled thereto, said housing defining a flow passage between the water supply source and the tubular member;

(b) a valve stem disposed within said flow passage and reciprocally movable between a closed position wherein said flow passage is blocked and an open position wherein said flow passage is unblocked;

(c) a check valve disposed within said flow passage for preventing the back-flow of water from the tubular member into the water supply source when the valve stem is in the open position; and (d) at least one air inlet valve disposed within said housing for creating a vacuum break when the fluid pressure in the flow passage is less than atmospheric pressure;

at least one elongate, tubular handle member attached to said housing; and a plunger member fluidly connected to the bottom end of said tubular member;

wherein said plunger member defines an interior cavity which is in fluid communication with the tubular member and includes a fluid outlet port, said plunger member being sized and configured to cover and form at least one fluid-tight seal about a drain opening of said plumbing fixture in a manner wherein water is directed from the water supply source, through the plunger device, and into the drain line via the outlet port;

said plunger member comprising:

(e) a bell-shaped upper portion having an annular lower surface defining a peripheral edge; and (f) a generally cylindrical portion extending downwardly from the lower surface and having an outer diameter dimension slightly exceeding the inner diameter dimension of the drain line, said outlet port being disposed within said cylindrical portion;

(g) said cylindrical portion forming a first seal against the inner surface of the drain line when received thereinto, and said peripheral edge forming a second seal against a portion of the interior surface of said plumbing fixture surrounding said drain opening when said cylindrical portion is received into the drain line; and the upper portion of the plunger member defines a first axis; and the cylindrical portion of the plunger member defines a second axis;

said first and second axes extending in spaced, generally parallel relation to each other.

* * * * *